US005865165A

United States Patent [19]

Brazier

[11] Patent Number: 5,865,165

[45] Date of Patent: Feb. 2, 1999

[54] GAS FIRED FIREPLACE BOILER

[76] Inventor: Dennis Brazier, Rte. 1 Box 220, Greenbush, Minn. 56726

[21] Appl. No.: 797,424

[22] Filed: Feb. 10, 1997

[51] Int. Cl.[6] ..... F24D 9/00

[52] U.S. Cl. ..... 126/101; 126/512; 126/513; 126/514; 126/85 B; 110/173 B

[58] Field of Search ..... 126/514, 513, 126/512, 85 B, 101; 110/173 B

[56] References Cited

U.S. PATENT DOCUMENTS

| | | | |
|---|---|---|---|
| 470,727 | 3/1892 | Wattles | 126/101 |
| 1,588,789 | 6/1926 | Werner | 126/512 |
| 4,909,227 | 3/1990 | Rieger | 126/512 |
| 5,398,669 | 3/1995 | McCullough et al. | 126/512 |
| 5,647,342 | 7/1997 | Jamieson et al. | 126/512 |

FOREIGN PATENT DOCUMENTS

| | | | |
|---|---|---|---|
| 17031 | 7/1904 | Austria | 126/512 |
| 18035 | 7/1910 | United Kingdom | 126/513 |
| 743388 | 1/1956 | United Kingdom | 126/513 |

*Primary Examiner*—Ira S. Lazarus
*Assistant Examiner*—David Lee
*Attorney, Agent, or Firm*—D. L. Tschida

[57] ABSTRACT

A low profile, high efficiency, fireplace boiler wherein a burner tray supports a number of gas fired burners and artificial logs within a hearth area of the firebox and about which logs the gas and flames are distributed. Combustion air is drawn from a conduit that surrounds an exhaust conduit at a chimney and circulated via a distributing manifold to the space beneath the burner tray, where it mixes with the fuel. Additional secondary air is directed from ports at intersecting levels of the tray to create flickering. Heated exhaust gasses are directed by a baffle to contact exposed walls of a liquid filled heat exchanger formed into the top and rear walls of the firebox and to pass through the bottoms of a number of vertical plenums mounted within the heat exchanger behind the baffle. A spring biased explosion door is provided beneath the burner tray. Liquid is circulated through the heat exchanger to distribution conduits arrayed about the premises.

14 Claims, 7 Drawing Sheets

GAS FIRED FIREPLACE BOILER

BACKGROUND OF THE INVENTION

The present invention relates to fireplaces and, in particular, to gas fired fireplaces, whether free standing or constructed as an insert, and a fireplace boiler.

A variety of primary and supplemental boiler heat sources have been developed over the years to accommodate a variety of fuel types. Most boiler systems are relegated to utility rooms, where they remain unseen. Some outdoor, wood fueled boilers, such as manufactured by applicant, are camouflaged in housings having the appearance of small utility sheds.

A variety of fireplace boilers and retrofit assemblies, which accommodate conventional brick fireplace constructions, have also been developed. A fireplace boiler provides the aesthetic benefits of an open fire combined with the practical ability to transfer heat energy to a larger area by circulating a liquid media through a conduit system.

Most fireplace boilers are constructed to accommodate wood and coal fuels. A variety of retrofit grate assemblies, which include conduits that support a boiler liquid, are particularly known. The grates support the wood and coal fuels. The generated heat is conducted through the walls of the heat exchanger to a contained liquid that, in turn, is conducted through conduits routed about the premises. Some exemplary grate assemblies can be found at U.S. Pat. Nos. 4,046,320; 4,131,231; 4,159,801; 4,159,802; 4,180,053; 4,159,802; 4,335,703; 4,355,625; and 4,473,061.

Some fireplace assemblies conduct heated gases within the hearth area to contact a remotely mounted heat exchanger. U.S. Pat. No. 4,453,532 discloses one such assembly. A transparent door screen assembly of the latter type is also shown at U.S. Pat. No. 4,137,896.

Other fireplace assemblies are known which include liquid conduits in the walls of the firebox. Two of such assemblies, which are intended for use with wood and coal, are shown at U.S. Pat. Nos. 4,271,816 and 4,584,987.

A variety of gas fired fireplaces are also known which distribute a decorative gas fired flame around artificial logs supported to an included grate. These fireplaces tend to be designed principally for aesthetics and not as an efficient heat source. They also frequently induce uncomfortable drafts. Some of these assemblies are shown at U.S. Pat. Nos. 5,584,680; 5,429,495; 5,392,763; 5,320,086; 5,114,336; 5,052,370; 5,081,981; 5,016,613; and 4,976,253.

The present invention was developed to provide a high efficiency gas fired fireplace. The fireplace is constructed to provide a contemporary external appearance and a glass front which optimally exposes the flame, without creating uncomfortable drafts. Heated combustion gasses are directed through a convoluted flow path which starts at a fresh air supply conduit at the chimney and terminates at an exhaust conduit at the chimney. Heat within the gasses is collected at a liquid heat exchanger and distributed through liquid conduits routed about the premises.

SUMMARY OF THE INVENTION

It is a primary object of the present invention to provide a gas fueled fireplace having a liquid filled heat exchanger.

It is a further object of the invention to provide a low profile firebox having an aesthetically pleasing appearance that exposes the flame for viewing, yet efficiently distributes the released heat energy to a liquid heat exchange system routed about the premises.

It is a further object of the invention to provide a firebox which conducts combustion gasses over and through the liquid heat exchanger to optimally extract heat and wherein a portion of the heat exchanger is offset to the rear of the firebox behind a burner and log assembly.

It is a further object of the invention to provide a firebox wherein the top and rear walls are constructed as a liquid filled heat exchanger, and wherein vertical plenums, which extend through the heat exchanger, conduct the gasses to an exhaust conduit at the chimney.

It is a further object of the invention to provide a baffle at the rear of the hearth space to isolate secondary combustion air from the heated exhaust gasses.

It is a further object of the invention to provide a spring biased explosion door beneath a burner tray to relieve pressure within the firebox in the event of a false burner ignition.

It is a further object of the invention to provide a multi-tiered burner tray having ports which direct intersecting streams of combustion air to induce flickering.

Various of the foregoing objects, advantages and distinctions of the invention are particularly obtained in one construction wherein the firebox provides a liquid heat exchanger at the top and rear walls. A removable front panel supports a transparent fire glass and defines a hearth space. The hearth space contains a multi-tiered burner tray which supports a number of natural or LP gas burners and artificial logs that distribute a flickering flame over the logs.

Primary combustion air is directed into shuttered ports at the burners, beneath the burner tray, from a distribution manifold that is connected to a supply conduit at the chimney. Secondary combustion air is directed from apertures in the burner tray into the hearth space and various of the air streams are directed to intersect to create turbulence and flickering.

The heated exhaust gases rise and are directed by a brick faced baffle at the rear of the hearth space to contact the heat exchanger. The heated gasses follow the top wall, are drawn downward behind the baffle and over the rear wall to a number of tubular plenums that vertically extend through an offset portion of the heat exchanger, where they rise to an exhaust conduit at the chimney. The offsetting of a portion of the heat exchanger behind the burners and logs reduces the height profile of the fireplace.

A spring biased explosion door is mounted below the burner tray to release the pressure of built up gases in the event of delayed burner ignitions. Associated gas supply and liquid flow controls are fitted to the rear wall of the fireplace.

Still other objects, advantages and distinctions of the invention will become more apparent from the following description with respect to the appended drawings. To the extent various modifications and improvements have been considered, they are described as appropriate. The following description should not be interpreted in limitation of the invention, which rather should be interpreted within the spirit and scope of the further appended claims.

BRIEF DESCRIPTION OF THE DRAWINGS

Wherein like reference numerals at the included figures refer to like parts.

DESCRIPTION OF THE PREFERRED EMBODIMENT

Figure 5:
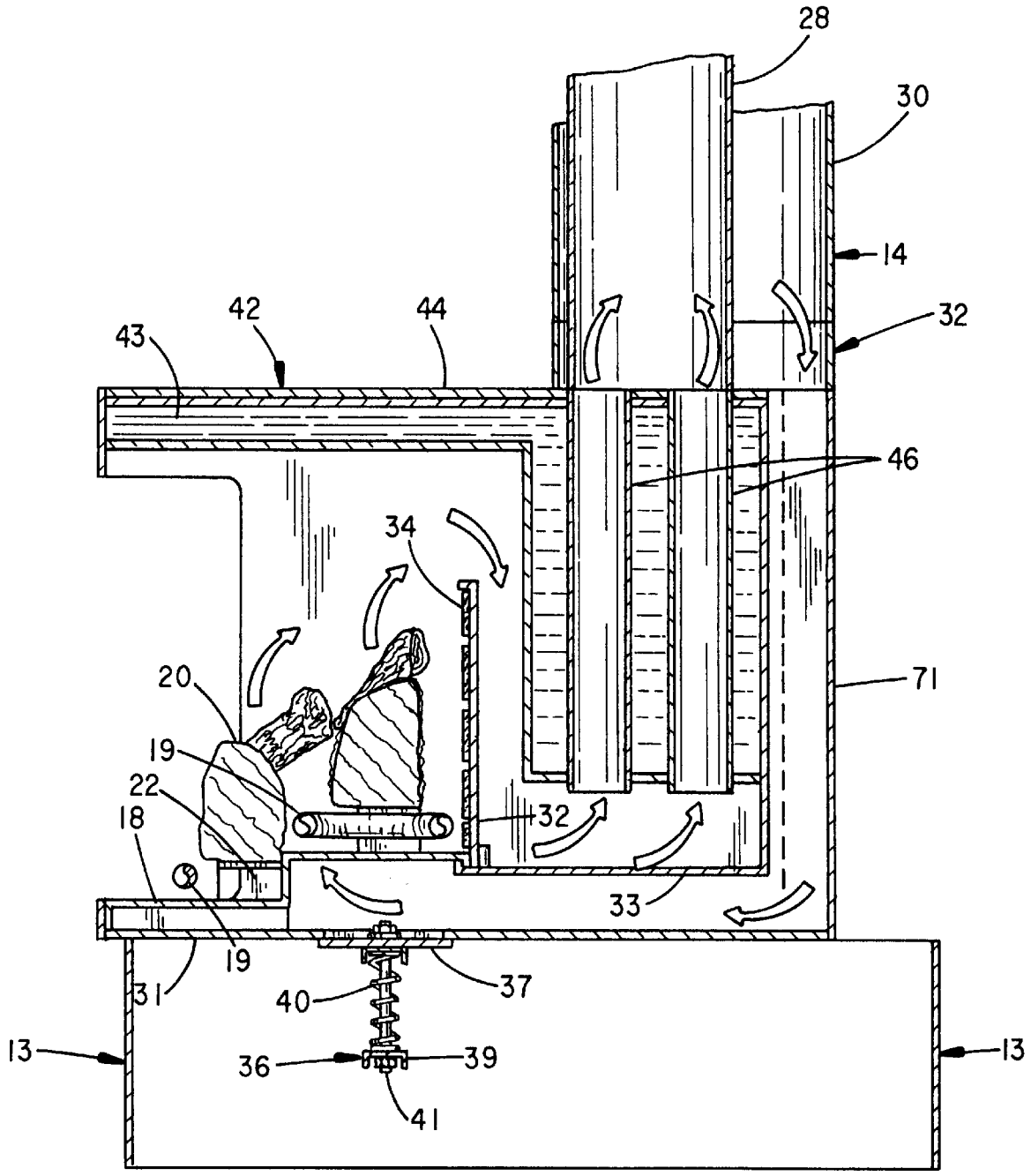
FIG. 5, taken along section lines 5—5 of FIG. 1, is an air flow diagram shown in side cross section through the firebox relative to the heat exchanger and circulated liquid.
Figure 6:
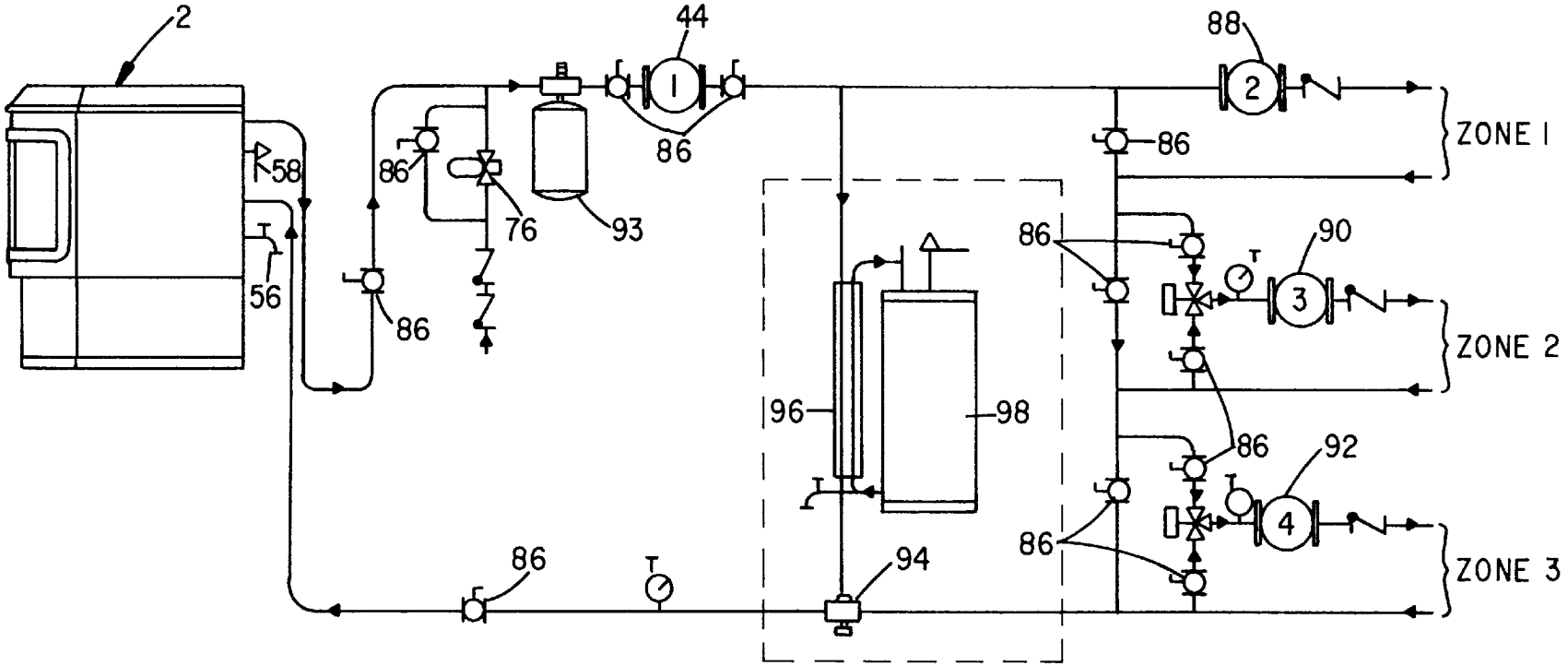
FIG. 6 is a liquid flow control schematic for a typical living space which includes the present fireplace.
Figure 7:
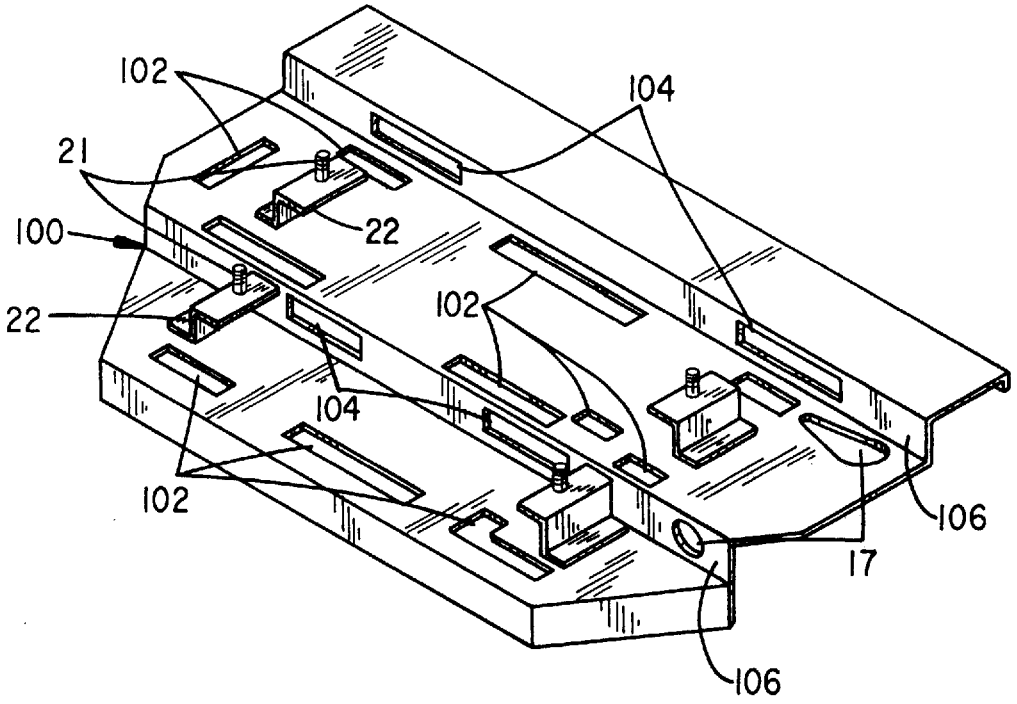
FIG. 7 is a perspective drawing of an alternative burner tray.

The construction of a presently preferred form of the fireplace boiler 2 of the invention is shown at FIGS. 1 through 4. The normal air flow through the fireplace 2 is shown at FIG. 5. FIG. 6 depicts a liquid distribution system for a typical heated premises, and FIG. 7 depicts an alternative burner tray. Various other constructions may also be constructed as noted below.

Figure 1:
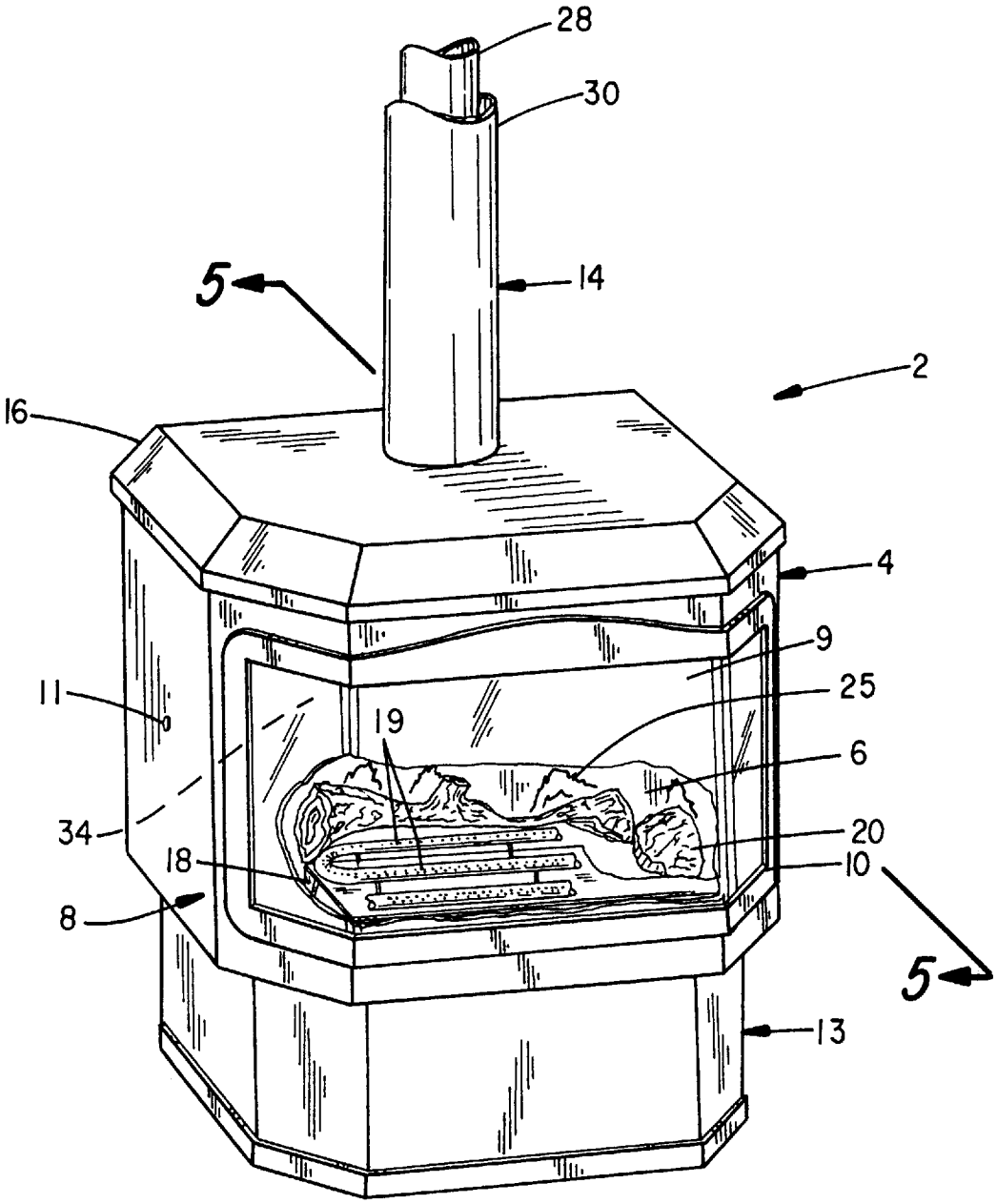
FIG. 1 is a perspective drawing shown in partial cutaway to the fireplace boiler of the invention.
Figure 2:
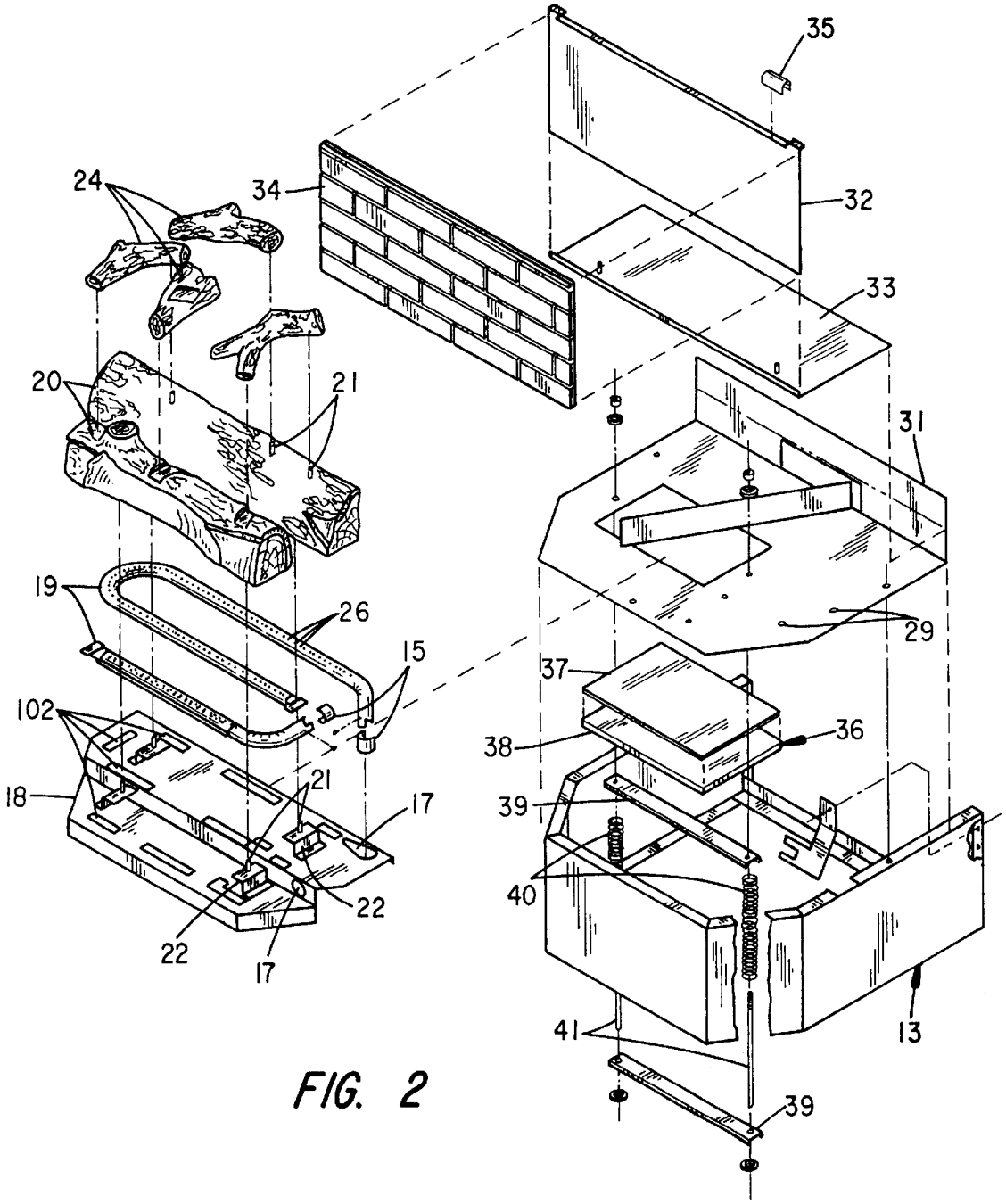
FIG. 2 is a perspective drawing shown in exploded assembly to the burner tray, burners, explosion door and artificial logs.

With attention to FIG. 1, a perspective drawing is shown in partial cutaway to the gas fired fireplace 2. The fireplace 2 is constructed to provide a low profile, aesthetically pleasing appearance and mount within the living space of a premises. The fireplace 2 includes an integral air to liquid heat exchanger. A portion of the heat exchanger is offset to the rear of the firebox to reduce the height profile. The fireplace 2 can complement an existing primary boiler heating system, such as shown it FIG. 6. Alternatively, the fireplace 2 can provide supplemental heat to separately installed conduits at the premises.

The fireplace 2 includes a multi-panel firebox 4. A central hearth space 6 is visible through a transparent front wall 8. The wall 8 supports a heat resistant, fire glass panel 9 behind a mounting ring or trim piece 10. The front wall 8 can be removed, upon inserting and rotating in Allen wrench at side apertures 11 to release internal latches 12, reference FIG. 3, which permit the wall 8 to slide forward. A support base 13 elevates the firebox 4 above the floor and a multi-chambered chimney 14 extends from a top cover panel 16.

Mounted within the hearth space 6 is a burner tray 18. With attention also directed to FIG. 2, the burner tray 18 supports a pair of gas fired burners 19 and artificial logs 20. The logs 20 are molded from a nonflammable material to exhibit a bark like exterior. Pins 21 extend from a number of bent tabs 22 that project from the burner tray 18 to secure the logs 20 to the tray 18 and above the burners 19. Twig pieces or branches 24 are similarly supported to the logs 20 at a number of pins 21.

A controlled supply of natural gas or propane gas is supplied to the burners 19 to support a flame 25 which appears to rise from the logs 20 and branches 24. The gas is pre-mixed with combustion air, which is admitted beneath the burner tray 18, and directed from a number of orifices 26 which are arrayed over the surfaces of the burners 19. The ends of the burners 19 mount through apertures 17 in the burner tray. The amount of combustion air is controlled with a shutter 15 at each burner 19. With the lighting of the gas, the flame 25 spreads about the logs 20. The numbers and shape of the logs 20 can be varied as desired. A variety of other nonflammable materials might also be supported to the burner tray 18 to facilitate the distribution of the flame.

As the air within the hearth space 6 is heated, a natural convection develops. Supply air is particularly fed from a supply conduit 30 at the chimney 14 and exhaust air is directed through an adjoining exhaust conduit 28, see also FIG. 5. The supply and exhaust air are appropriately conducted from and to the chimney 14 via channels defined by baffles (not shown) within an intermediate distribution manifold 32 supported beneath the cover panel 16 at the base of the chimney 14.

The conduit 28 is offset to one side of the conduit 30 and downsized from the conduit 30. The conduit 28 exhibits a diameter of 3 to 4 inches and the conduit 30 exhibits a diameter of 6 to 8 inches. Sufficient supply air is obtained with the foregoing chimney construction to adequately supply the flame 25 without inducing drafts at the premises and despite the opposing counter flows of cold supply or combustion air versus heated exhaust air that occurs in the chimney 14. The offsetting of the conduit 28 to contact the conduit 30 has been found to facilitate the counter flow. Uncomfortable drafts are also avoided by directly venting the fireplace 2 to the outside air.

Supported from the rear edge of the burner tray 18 and behind the logs 20 and above the floor 31 of the firebox 4 is a baffle 32. The baffle 32 is raised above the floor and offset toward the front wall 8 by a shelf 33. The burner tray 18, shelf 33 and floor 31 define a horizontal air channel which directs supply air beneath the burner tray 18 and into the burners 19. The baffle 32 directs the exhaust gasses vertically. A brick veneer 34 is secured with clips 35 or a bent edge of the baffle 32 to cover the front of the baffle 32.

Separately supported to the floor 31, beneath the center of the burner tray 18, is a spring biased explosion door assembly 36. Holes 29 in the floor 31, positioned to the side of the explosion door 36, support gas distribution orifices (not shown) which couple the gas fuel to the shuttered ends of the burners 19.

The explosion door 36 is constructed of a nonflammable panel 37 which is exposed within the firebox 4 and supported to a steel panel 38. The panels 37 and 38 are supported to a pair of cross members 39 which are separated by a pair of springs 40 that are fitted to a pair of guide rods 41 that depend from the floor 31. In the event of a delayed ignition and explosion at the burners 19, the expansion of the gas within the firebox 4 causes the plates 37 and 38 to slide on the guide rods 41 and relieve the pressure to the space beneath the support base 13.

The top and rear walls of the firebox 4 are defined by a liquid heat exchanger 42. As the heated exhaust gasses rise and are directed by the baffle 32, the gasses are directed over a number of exposed surfaces of the heat exchanger 42 to transfer heat from the exhaust gasses to a liquid media 43 circulated through the heat exchanger 42. The liquid heat transfer media 43 can consist of a variety of mixtures, for example, water and glycol and other non corrosive additives. The liquid media 43 is circulated through the heat exchanger 42 under the control of a remotely mounted circulation pump 44 at the premises, reference FIG. 6. The liquid media 43 may be supplied to a primary boiler heating system and various heat radiator, that are displaced about a single room or about the premises in different zones. A typical distribution system is discussed below with respect to FIG. 6.

Figure 3:
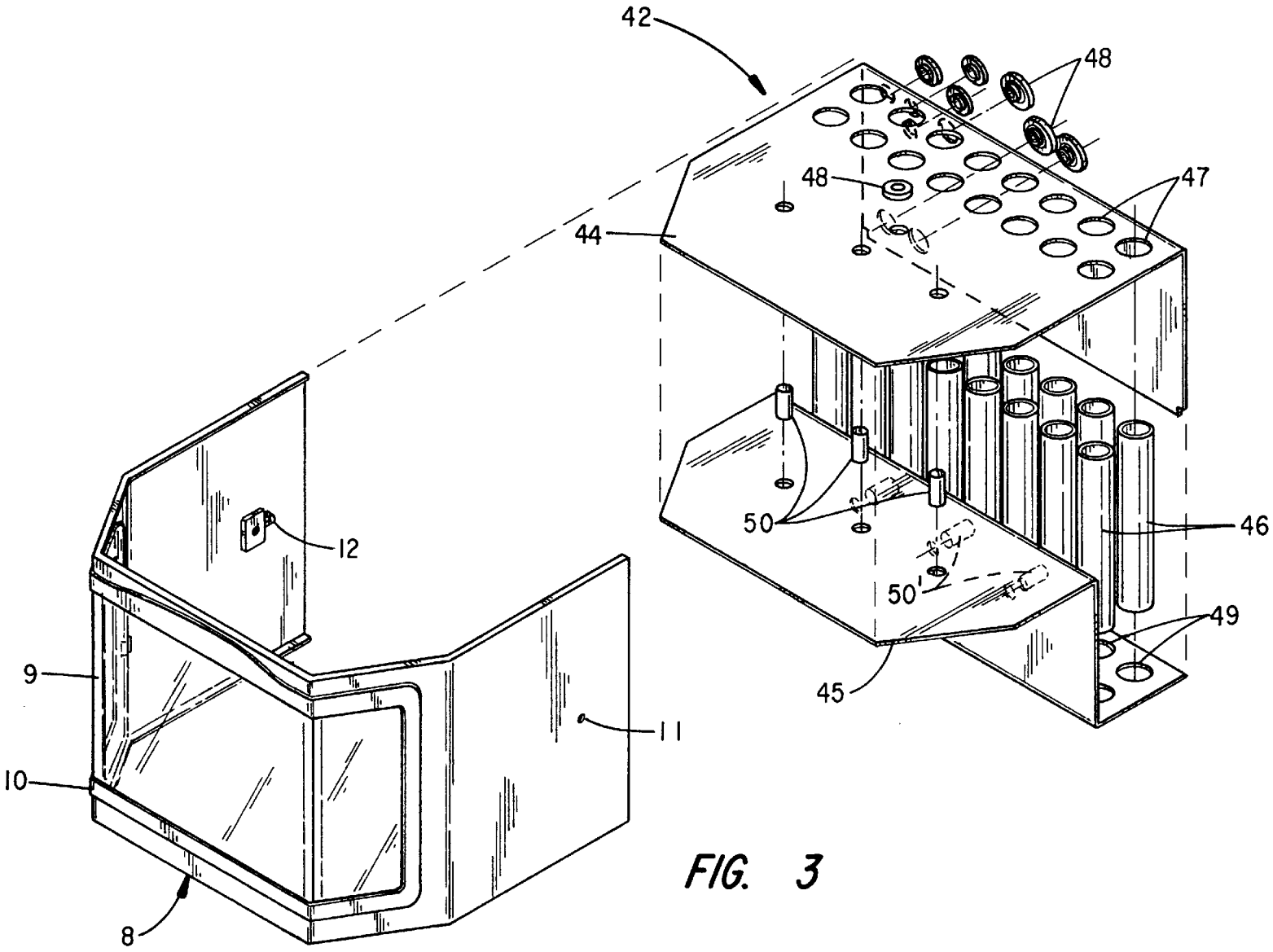
FIG. 3 is a perspective drawing shown in exploded assembly to the liquid heat exchanger of the fireplace.
Figure 4:
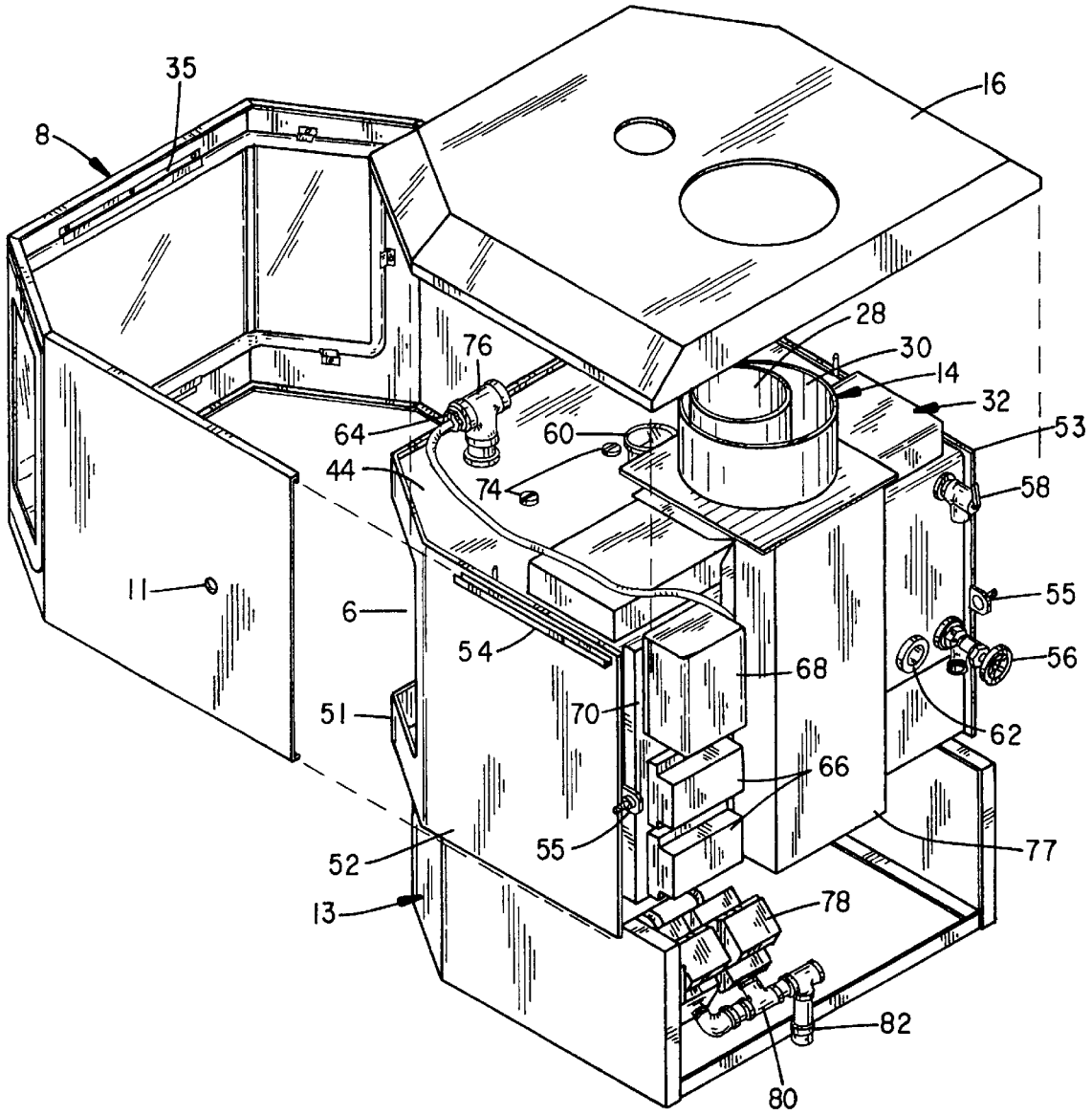
FIG. 4 is a perspective drawing shown in exploded assembly to the wall panels and control assemblies of the fireplace.

More of the details to the heat exchanger 42 are apparent from the exploded assembly drawing of FIG. 3 and the assembly drawing of FIG. 4. Particularly depicted are the top and bottom wall panels 44 and 45 and a number of vertical plenum tubes 46 that conduct the heated exhaust air through the core of the heat exchanger 42. The plenum tubes 46 provide a 2 inch outside diameter and are supported at holes 47 cut into the panel 44. The top of each tube 46 is welded to the wall panel 44. The bottom of the tubes 46 are separately welded at a number of holes 49 let into the bottom wall panel 45. Threaded bungs 48 are separately fitted to top and rear surfaces of the wall panel 44.

A number of stays or spacers 50 and 50' are separately provided between the wall panels 44 and 45 to maintain a uniform spacing over the wall surfaces. The length of the stays 50 and 50' is varied as appropriate in relation of the dimensions and desired volume of the heat exchanger 42, for example, the vertical stays 50 are 2 inches and the horizontal stays 50' are 7¾ inches. Presently, the manifold 43 is constructed to contain seven gallons of liquid and the fireplace 2 exhibits a height of 31.5 inches, a width of 28.5 inches and a depth of 26 inches.

The peripheral edges of the top and bottom wall panels 44 and 45 are welded to a front rim panel 51 and right and left side wall panels 52 and 53 to define a liquid tight chamber. The wall panels 44 and 45 are formed from ¼ inch sheet steel, which is sufficient to sustain the heating and cooling cycles that occur within the hearth space 6 and without warping. It is to be appreciated the heat exchanger 42 can be constructed to other shapes and with a variety of heat transmissive materials.

With attention to FIG. 4, the heat exchanger 42 is constructed to lie beneath the cover panel 16. A slight separation or airspace is provided between the cover 16 and heat exchanger 36 to prevent burns upon accidental contact with the fireplace 2. The removable front wall panel 8 and glass 9 are fitted to the side walls 52 and 53 to slide along the bottom peripheral edges of the walls 52 and 53 at rails 54 that project from the side walls 52 and 53. The latches 12 interlock with catches 55 to retain the wall panel 8.

Also shown at FIG. 4 and mounted to the rear surface of the wall panel 44 is a fill/drain valve 56, pressure relief valve 58, pressure gauge 60, fill coupler 62 and a capillary tube and bulb 64. Tempering controls 66 and an electronic boiler control module 68, which controls the distribution of the liquid 38 and gas, are supported to a separate panel 70, displaced to the side of a vertical air supply plenum 71 of the air distribution manifold 32. A number of threaded plugs 74, an automatic air bleed valve 76, and a horizontal section of the air distribution manifold 32, which spans the width of the firebox 4, are also arrayed to the wall 44.

An appropriate gas valve 78 (i.e. natural or LP), gas conduits 80 and condensation trap 82 are separately fitted to depend into the support base 13, beneath the bottom wall 31. The fireplace 2 presently accommodates direct spark ignition at the two burners 19 and three heat settings.

FIG. 6 depicts a typical multiple zone radiant heating system that, depending upon the climate, might be supported by the fireplace 2. Attendant conduits or piping are routed about the premises to appropriately conduct the liquid 43. A number of electronically controlled gate valves 86 are positioned about the system to conduct the liquid 43 through multiple heating zones 1–3 under the further control of a number of circulation pumps 44, 88, 90, and 92. A temperature controller (not shown) within the premises typically regulates liquid flow via the gate valves 86 at zones 2 and 3. The primary system controller may or may not be coupled to the controller 68 at the fireplace 2. An expansion tank 93 is supplied to control system air. A priority valve 94 may also couple the heated liquid 38 to a liquid to liquid heat exchanger 96 that supplies a system water heater 98.

Additional extraneous pathways may also be provided in the heating system to bleed-off undesired heat during mild heating days. Such pathways permit continuous circulation of the coolant, which if otherwise allowed to remain stagnant, could create undue system pressures or possibly result in the freezing of the liquid with a resultant bursting of the conduits.

FIG. 7 depicts an alternative burner tray 100 which can be substituted for the burner tray 18. The burner tray 100 is constructed to enhance the flickering of the flames 25. Normal movement or flickering at the flame 25 is created with the passage of secondary combustion air through apertures 102 that are arrayed about the horizontal tiers of the trays 18 and 100. The apertures 102 are judiciously positioned to the sides of the burners 19 to facilitate this effect. Some secondary air also flows around the sides of the tray 18.

The tray 100 includes additional apertures 104 in the vertical risers 106 which also admits secondary combustion air and creates intersecting air streams with the air from the apertures 102 to cause turbulence and enhance the flickering at the flame. A flickering flame particularly enhances the aesthetic appeal of the fireplace 2. The size and positioning of the apertures 102 and 104 can be varied to provide a desired degree of flickering.

While the invention has accordingly been described with respect to its presently preferred construction and various modifications and improvements thereto, it is to be appreciated still other constructions may suggest themselves to those skilled in the art. Accordingly, the following claims should be interpreted to include all those equivalent embodiments within the spirit and scope thereof.

What is claimed is:

1. Heating apparatus comprising:

a) a firebox having a plurality of walls, which enclose a hearth space, and including a chimney having a first conduit mounted within a second conduit communicating with said hearth space, wherein said second conduit couples combustion air to the hearth space and said first conduit exhausts heated gasses;

b) heat exchange means having a plurality of walls and ones of which walls define a top wall and a rear wall of said hearth space for containing a liquid and transferring heat to said liquid;

c) burner means for distributing a gaseous fuel and flame about artificial logs supported within said hearth space and heating said combustion air;

d) baffle means for directing heated exhaust gasses to contact the top wall of said heat exchange means, to pass downward over the rear wall to a plurality of vertical plenums which extend through said heat exchange means, and to conduct the exhaust gasses to said chimney through said vertical plenums; and e) means for circulating a liquid through said heat exchange means to extract and distribute heat to premises containing said heating apparatus.

2. Heating apparatus as set forth in claim 1 including explosion means supported beneath said burner means for relieving pressures within the hearth space in the event of a delayed burner ignition.

3. Heating apparatus as set forth in claim 2 wherein said explosion means comprises a plate mounted to guide means for resiliently supporting the plate to cover a port communicating with said hearth space.

4. Heating apparatus as set forth in claim 1 including air distribution means having a first channel communicating with said second conduit and a space beneath a burner tray which supports said logs and a second channel communicating with said vertical plenums and said first conduit.

5. Heating apparatus as set forth in claim 4 wherein one of said walls comprises a front panel having a transparent glass surface mounted to slide at side walls of said firebox and wherein latches retain said front panel to said firebox.

6. Heating apparatus as set forth in claim 4 wherein said burner tray supports a gas fueled burner and a plurality of artificial logs, and wherein a plurality of apertures direct secondary combustion air to induce flickering in a flame emitted from said burner.

7. Heating apparatus as set forth in claim 6 wherein said burner tray includes a plurality of horizontal and vertical walls, wherein said plurality of apertures are provided in said plurality of horizontal and vertical walls and streams of secondary combustion air pass through said plurality of apertures to intersect and induce turbulence and flickering at said flame.

8. Heating apparatus comprising:

a) a firebox having a plurality of walls, which enclose a hearth space, and including a chimney having a first conduit mounted within a second conduit communicating with said hearth space, wherein said second conduit couples combustion air to the hearth space and said first conduit exhausts heated gasses;

b) heat exchange means having a plurality of walls and ones of which walls define a top wall and a rear wall of said hearth space for containing a liquid and transfering heat to said liquid;

c) burner means mounted to a burner tray for distributing a gaseous fuel and flame about artificial logs supported within said hearth space and heating said combustion air;

d) baffle means for directing heated exhaust gasses to contact the top wall of said heat exchange means, to pass downward over the rear wall behind a baffle plate to a plurality of vertical plenums which extend through said heat exchange means, and to conduct the exhaust gasses to said chimney through said vertical plenums; and e) explosion means supported beneath said burner means for relieving pressures within the hearth space in the event of false burner ignitions; and f) means for circulating a liquid through said heat exchange means to extract and distribute heat to premises containing said heating apparatus.

9. Heating apparatus as set forth in claim 8 wherein said burner tray includes a plurality of horizontal and vertical walls, wherein a plurality of apertures are provided in said plurality of horizontal and vertical walls and streams of secondary combustion air pass through said plurality of apertures to intersect and induce turbulence and flickering at said flame.

10. Heating apparatus as set forth in claim 8 wherein said explosion means comprises a floor plate mounted beneath said burner tray to guide means for resiliently supporting the floor plate to cover a port communicating with said hearth space.

11. Heating apparatus as set forth in claim 8 including air distribution means having a first channel communicating with said second conduit and a space beneath said burner tray and a second channel communicating with said vertical plenums and said first conduit, wherein primary combustion air is directed to shuttered apertures to said burner means beneath said burner tray.

12. Heating apparatus as set forth in claim 11 wherein said burner tray includes a plurality of horizontal and vertical walls, wherein a plurality of apertures are provided in said plurality of horizontal and vertical walls and streams of secondary combustion air pass through said plurality of apertures to intersect and induce turbulence and flickering at said flame.

13. Heating apparatus comprising:

a) a firebox having a plurality of walls, which enclose a hearth space, and including a chimney having a first conduit mounted within a second conduit communicating with said hearth space, wherein said second conduit couples combustion air to the hearth space and said first conduit exhausts heated gasses;

b) heat exchange means having a plurality of walls and ones of which walls define a top wall and a rear wall of said hearth space for containing a liquid and transferring heat to said liquid;

c) burner means mounted to a burner tray for distributing a gaseous fuel and flame about artificial logs supported to said burner tray within said hearth space;

d) air distribution means having a first channel communicating with said second conduit and a space beneath said burner tray and a second channel communicating with said vertical plenums and said first conduit;

e) baffle means for directing heated exhaust gasses to contact the top wall of said heat exchange means, to pass downward over the rear wall behind a baffle plate to a plurality of vertical plenums which extend through said heat exchange means, and to conduct the exhaust gasses to said first conduit through said vertical plenums;

f) explosion means comprising a floor plate mounted to guide means for resiliently supporting the plate to cover a port communicating with said hearth space beneath said burner tray for relieving pressures within the hearth space in the event of false burner ignitions; and g) means for circulating a liquid through said heat exchange means to extract and distribute heat to premises containing said heating apparatus.

14. Heating apparatus as set forth in claim 13 wherein said burner tray includes a plurality of horizontal and vertical walls, wherein a plurality of apertures are provided in said plurality of horizontal and vertical walls and streams of secondary combustion air pass through said plurality of apertures to intersect and induce turbulence and flickering at said flame.

* * * * *